US009162343B2

(12) United States Patent
Glaser et al.

(10) Patent No.: US 9,162,343 B2
(45) Date of Patent: Oct. 20, 2015

(54) APPARATUS, SYSTEM, AND METHOD FOR SHARPENING A TOOL IN A FIXED GEOMETRY

(71) Applicant: Glendo Corporation, Emporia, KS (US)

(72) Inventors: Donald J. Glaser, Emporia, KS (US); Lon C. Tidwell, Emporia, KS (US)

(73) Assignee: Glendo LLC, Emporia, KS (US)

( * ) Notice: Subject to any disclaimer, the term of this patent is extended or adjusted under 35 U.S.C. 154(b) by 214 days.

(21) Appl. No.: 13/759,665

(22) Filed: Feb. 5, 2013

(65) Prior Publication Data

US 2014/0220865 A1 Aug. 7, 2014

(51) Int. Cl.
*B24B 41/06* (2012.01)

(52) U.S. Cl.
CPC ..... *B24B 41/066* (2013.01)

(58) Field of Classification Search
None
See application file for complete search history.

(56) References Cited

U.S. PATENT DOCUMENTS

| | | | | |
|---|---|---|---|---|
| 975,329 | A | 11/1910 | Collins | |
| 1,192,416 | A | 7/1916 | Graves | |
| 2,337,400 | A * | 12/1943 | Maute | 279/53 |
| 2,688,828 | A | 9/1954 | Aulenbach | |
| 2,998,683 | A | 9/1961 | Wegener | |
| 3,566,550 | A | 3/1971 | Piccinino | |
| 3,932,964 | A | 1/1976 | Simms | |
| 4,078,338 | A | 3/1978 | Baughcom | |
| 4,217,735 | A | 8/1980 | McGeoch et al. | |
| 5,243,795 | A * | 9/1993 | Roberts | 52/158 |
| 5,582,542 | A * | 12/1996 | Stein | 451/367 |
| 6,393,712 | B1 | 5/2002 | Jansson | |
| 6,579,163 | B1 * | 6/2003 | Ross et al. | 451/545 |
| 6,935,937 | B2 | 8/2005 | Port | |
| 2003/0079353 | A1 * | 5/2003 | Lovell et al. | 30/392 |
| 2008/0085666 | A1 | 4/2008 | Lindsay et al. | |

FOREIGN PATENT DOCUMENTS

| | | |
|---|---|---|
| JP | 2000202748 | 7/2000 |

* cited by examiner

*Primary Examiner* — Joseph J Hail
*Assistant Examiner* — Brian Keller
(74) *Attorney, Agent, or Firm* — Erise IP, P.A.

(57) ABSTRACT

A system for sharpening a tool bit in a fixed geometry has a base with a support platform and guide rod attached to and extending from the platform; a fixture including a longitudinal extending body with a plurality of linear bore holes extending through a transverse width of the fixture; and a tool bit support assembly removeably connected to the fixture for receiving the tool bit. In operation, the system provides for a user to insert the guide rod through one of the bore holes in the plurality and to position the tool bit in a fixed orientation for sharpening a free end of the tool bit. By forming the fixture with a specific number of bore holes, each positioned at a precise angle within the fixture, the system provides for the sharpening of the tool bit in a fixed geometry in a way that is consistent, precise, and repeatable.

12 Claims, 17 Drawing Sheets

APPARATUS, SYSTEM, AND METHOD FOR SHARPENING A TOOL IN A FIXED GEOMETRY

BACKGROUND

1. Field

Embodiments of the present invention are directed to an apparatus, system, and method for sharpening a tool in a fixed geometry. In particular, embodiments of the present invention are directed to sharpening an engraving tool bit in a fixed geometry, such that the tool bit can be repeatedly and consistently sharpened in the fixed geometry.

2. Related Art

Engravers currently employ various types of systems, devices, and methods to sharpen and hone their engraving tools. The simplest system comprises an engraving bit and a sharpening material, such as a stone. The engraver simply rubs the engraving bit against the sharpening material to hone a cutting edge on the engraving bit. As can be appreciated, such a rudimentary procedure is fraught with uncertainty and the potential for error. Any small angle variation in the placement of the bit against the sharpening material can dramatically alter the cutting edge and the operability of the bit.

To combat error and uncertainty, engravers sometimes employ the use of engraving fixtures, which allow the engraving bit to be held in specified orientations, with each specified orientation corresponding to a face angle on an end of the engraving bit. However, most engraving fixtures are completely adjustable, such that the engraver can position the engraving bit in nearly an infinite number of different orientations. Thus, consistently positioning the tool bit in a specified orientation for sharpening can be difficult and cumbersome. In addition, many professional and amateur engravers either do not know the technical face angles with which to hone the tool bits or do not want hassle with trying to adjust the tool-bit fixtures to place the tool bit in the required precise orientations.

SUMMARY

Embodiments of the present invention provide a system for sharpening a tool bit in a fixed geometry. The system of embodiments of the present invention comprises a base with a support platform and guide rod attached to and extending from the platform; a fixture including a longitudinal extending body with a plurality of linear bore holes extending through a transverse width of the fixture; and a tool bit support assembly removeably connected to the fixture for receiving the tool bit. In operation, the system of embodiments of the present invention provides for a user to insert the guide bar through one of the bore holes in the plurality of bore holes, positioning the tool bit in a fixed orientation for sharpening an end of the tool bit. By forming the fixture with a specific number of bore holes each positioned at a precise angle within the fixture, the system of embodiments of the present invention provides for the sharpening of a tool bit in a fixed geometry in a way that is simple, accurate, and repeatable.

Embodiments of the present invention further include a method for sharpening a tool bit in a fixed geometry. Given the system provided above, including a fixture with five bore holes, the first step is to insert the guide rod through a first bore hole of the five linear bore holes, starting at the bottom of the fixture, and lowering the fixture around the guide rod until a distal end of the tool bit contacts a sharpening material. Next, the sharpening material is caused to move with respect to the tool bit such that the sharpening material forms a first shape angle face on a first bottom-facing side of the distal end of the tool bit. In the next step, the guide rod is inserted through a second bore hole of the five linear bore holes, starting at the bottom of the fixture, and lowering the fixture around the guide rod until the distal end of the tool bit contacts the sharpening material. Next, the sharpening material is caused to move with respect to the tool bit such that the sharpening material forms a second shape angle face on a second bottom-facing side of the distal end of the tool bit. In the next step, the guide rod is inserted through a third bore hole of the five linear bore holes, starting at the bottom of the fixture, and lowering the fixture around the guide rod until the distal end of the tool bit contacts the sharpening material. Next, the sharpening material is caused to move with respect to the tool bit such that the sharpening material forms a first heel face on the first bottom-facing side of the distal end of the tool bit. In the next step, the guide rod is inserted through a fourth bore hole of the five linear bore holes, starting at the bottom of the fixture, and lowering the fixture around the guide rod until the distal end of the tool bit contacts the sharpening material. Next, the sharpening material is caused to move with respect to the tool bit such that the sharpening material forms a second heel face on the second bottom-facing side of the distal end of the tool bit. In the next step, the guide rod is inserted through a fifth bore hole of the five linear bore holes, starting at a top of the fixture, and lowering the fixture around the guide rod until the distal end of the tool bit contacts the sharpening material. Next, the sharpening material is caused to move with respect to the tool bit such that the sharpening material forms a face angle face on top-facing sides of the distal end of the tool bit. Such an embodiment provides for the sharpening of a tool bit in a fixed geometry in a way that is simple, accurate, and repeatable. Specifically, the embodiment provides for the forming and honing of a cutting edge on the distal end of the tool bit, with the end of the tool bit including five angle faces.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWINGS

Embodiments of the present invention are described in detail below with reference to the attached drawing figures, wherein.

Figure 1:
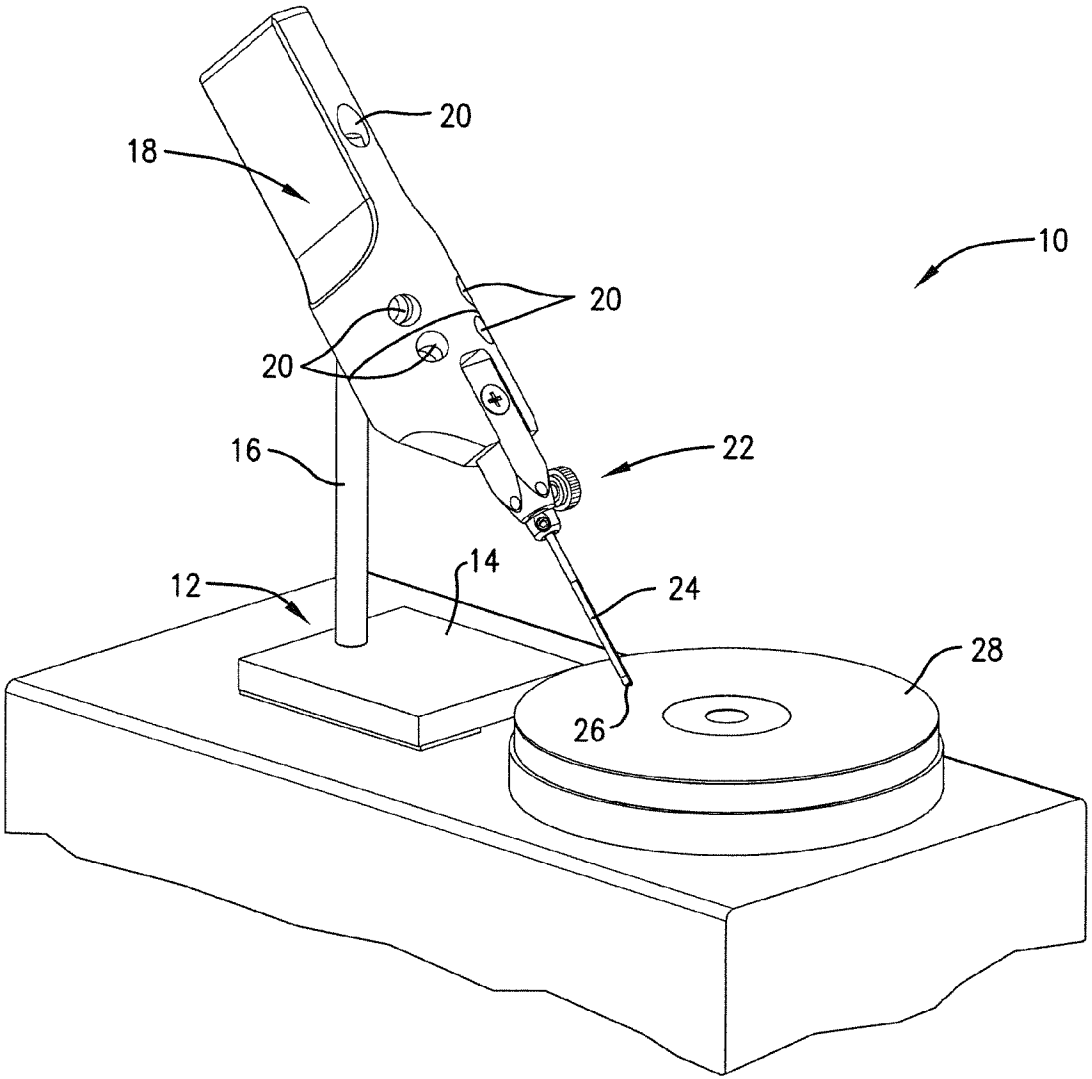
FIG. 1 is a perspective view of a tool bit sharpening system of embodiments of the present invention.

The drawing figures do not limit the present invention to the specific embodiments disclosed and described herein. The drawings are not necessarily to scale, emphasis instead being placed upon clearly illustrating the principles of the invention.

DETAILED DESCRIPTION

The following detailed description references the accompanying drawings that illustrate specific embodiments in which the invention may be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

Referring to the drawings, a system 10 for sharpening a tool bit in a fixed geometry in accordance with embodiments of the present invention is shown in FIG. 1. The system 10 broadly comprises a base 12 including a support platform 14 and a guide rod 16; a fixture 18 with a plurality of bore holes 20 for receiving the guide rod; and a tool bit support assembly 22 attached to the fixture for securing a linear tool bit 24. After the linear tool bit 24 is attached, via the support assembly 22, a free end 26 (or distal end) of the tool bit can be brought into contact with a sharpening material 28, such as a rotating grinding wheel, for sharpening the end of the tool bit. By placing the end 26 of the tool bit 24 against the sharpening material 28 while the guide rod 16 is consecutively inserted into each of the bore holes of the plurality of bore holes 20, the tool bit can be sharpened in a fixed geometry in a manner that can be precisely and repeatably performed as necessary. As used throughout, distal refers to a direction towards the free end 26 of the tool bit 24, while proximal refers to a direction away from the distal end of the tool bit.

Figure 2:
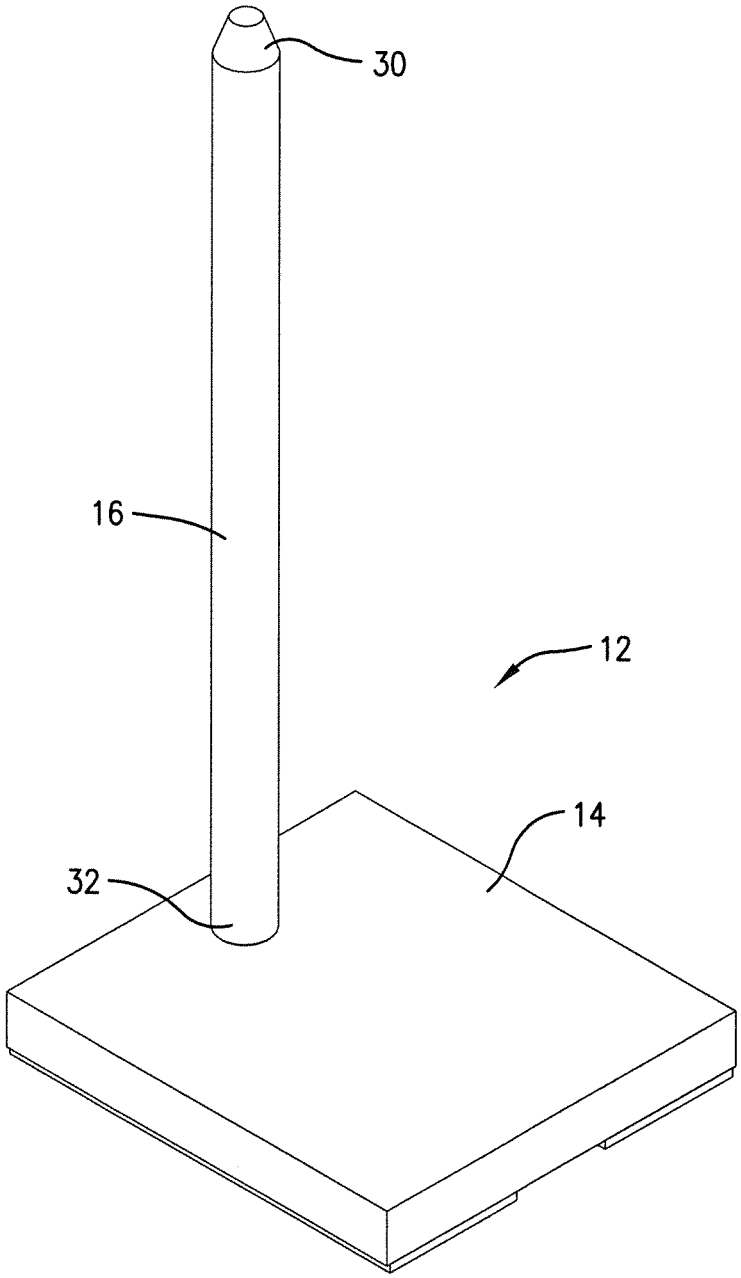
FIG. 2 is a perspective view of a base of the tool bit sharpening system of FIG. 1.

The base 12 is shown FIG. 2 and includes the support platform 14 and the guide rod 16 attached to the platform. The support platform 14 is a foundational piece of material that provides support for the guide rod 16 and the remaining components of the system 10 of embodiments of the present invention. The support platform 14 includes a generally flat bottom surface so that the platform may be stably positioned on a table top, desk, or other corresponding flat surface. The support platform 14 may be formed in a plurality of shapes, such as rectangular, circular, or the like, so long as the platform provides stable support for the remaining components of the system. The guide rod 16 is a linear shaft with top and bottom ends 30, 32, with the bottom end 32 of the shaft attached to the support platform such that a longitudinal axis of the guide rod is generally orientated vertically. The guide rod 16 may be formed in various lengths and diameters as may be required to implement embodiments of the present invention. However, as will be discussed in more detail below, a diameter of the guide rod should correspond to diameters of the plurality of bore holes 20 of the fixture 18, such that the plurality of bore holes can receive the guide rod 16.

Figure 3:
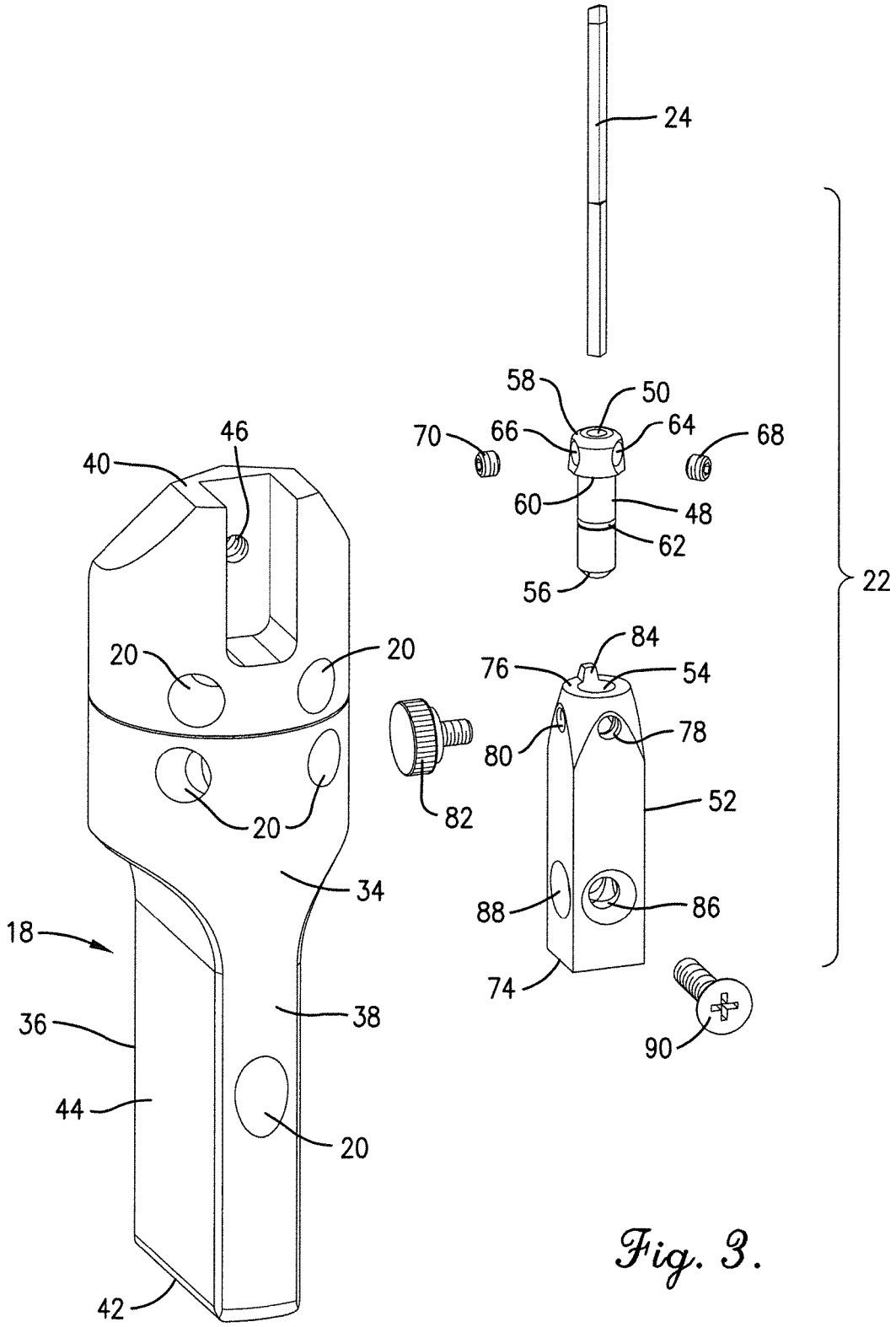
FIG. 3 is a bottom exploded perspective view of a fixture, receiver, carrier block, and tool bit of the tool bit sharpening system of FIG. 1.
Figure 4:
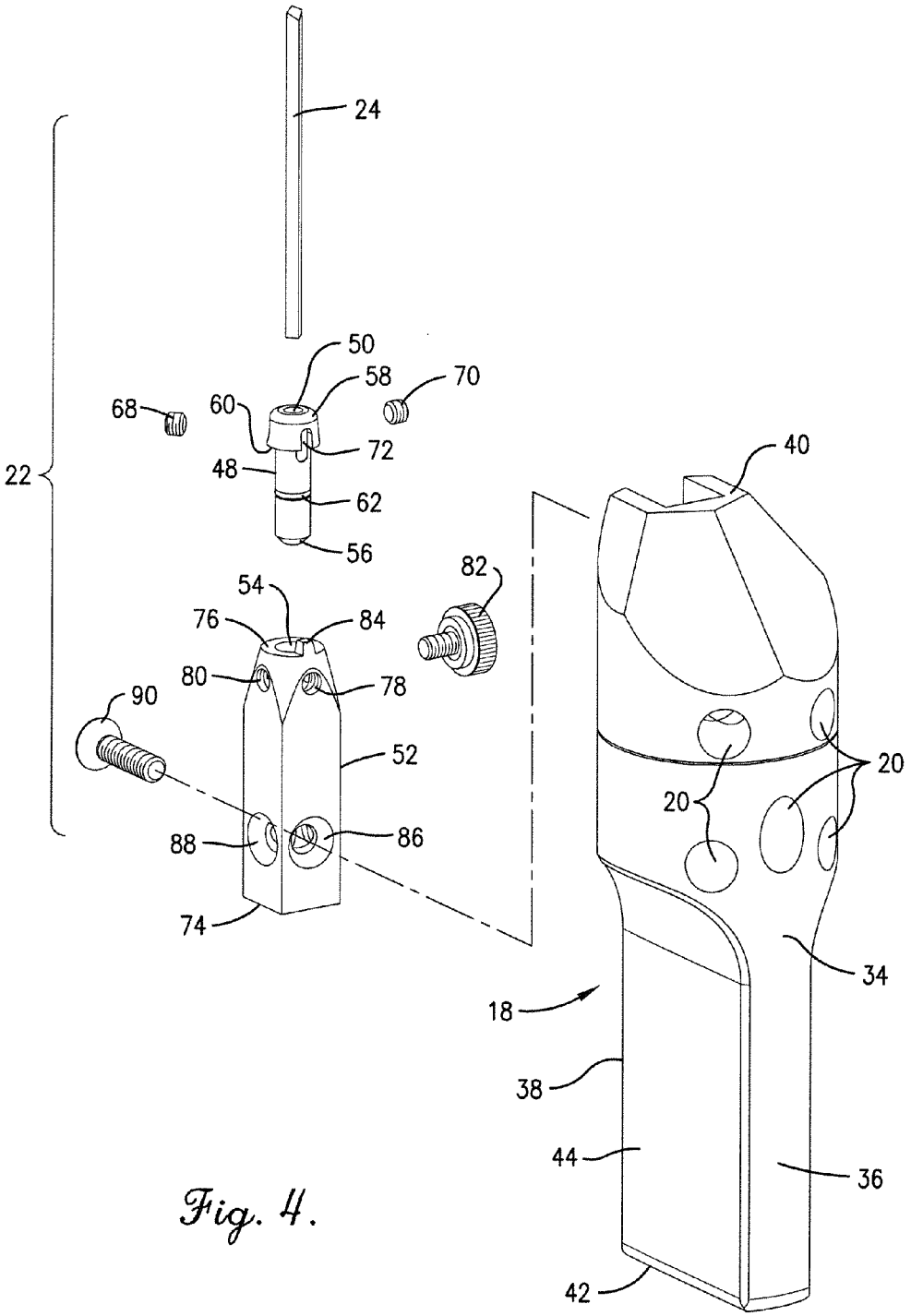
FIG. 4 is a top exploded perspective view of the fixture, receiver, carrier block, and tool bit of the tool bit sharpening system of FIGS. 1 and 3.

The fixture 18 is shown in FIGS. 3-4 and includes a longitudinally extending body 34, top and bottom sides 36, 38, distal and proximal ends 40, 42, and the plurality of bore holes 20 that extend through a transverse width of the fixture. In certain embodiments, the fixture 18 is generally cylindrical in shape. However, in other embodiments, such as that illustrated in FIGS. 3-4, a portion of the proximal end 42 of the fixture 18 may not be completely cylindrical. In such an embodiment, at least a portion of the material of the fixture's body 34 adjacent to the proximal end 42 may be reduced, presenting a handle 44, to facilitate grasping by a user of embodiments of the present invention. The above-stated fixture shapes are provided for exemplary purposes. Embodiments of the present invention contemplate fixtures of a variety of shapes and sizes that function in the manner described herein. In addition, certain embodiments may provide for the distal end 40 of the fixture 18 to include a threaded transverse opening 46 extending partially through the body, with the threaded transverse opening used to secure the tool bit assembly 22 to the fixture, as will be discussed in more detail below.

Figure 5:
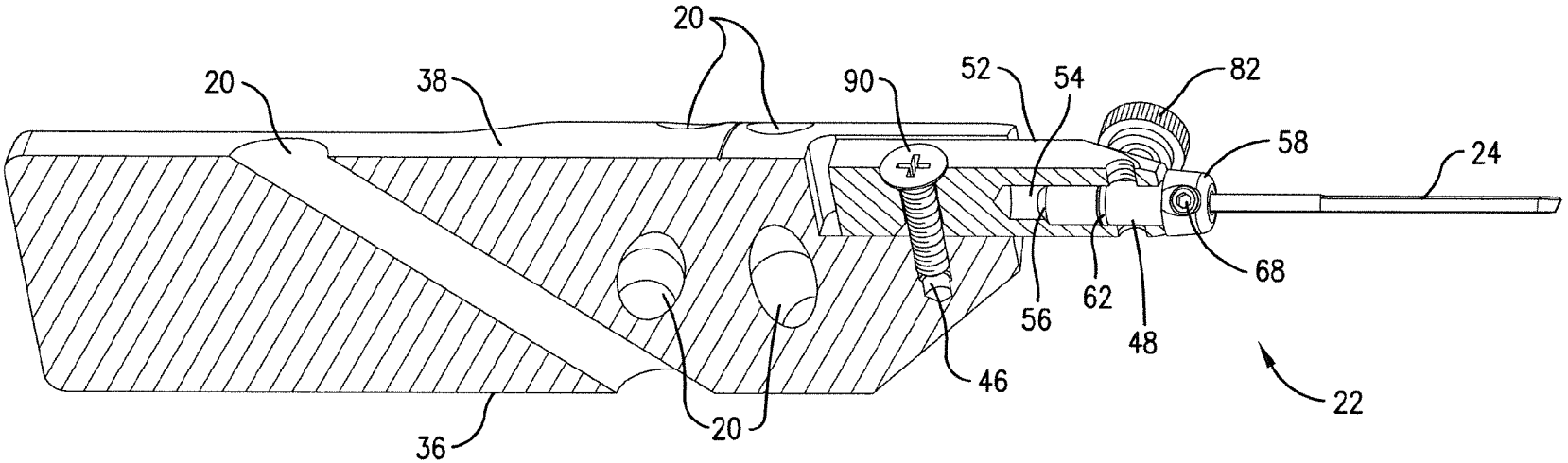
FIG. 5 is longitudinal partial cross-sectional view of the fixture, receiver, carrier block, and tool bit of the tool bit sharpening system of FIGS. 1 and 3-4.

As illustrated in FIG. 5, the plurality of bore holes 20 extends generally from the top side 36 of the fixture 18 to the bottom side 38 of the fixture, with each bore hole in the plurality extending in a unique direction within the fixture. As was briefly described above, the diameters of the bore holes 20 correspond to the diameter of the guide post 16, such that the guide post can be received within each bore hole included in the fixture 18. The number of bore holes included in the plurality of bore holes 20 and their corresponding orientations through the fixture 18 are dependent on a number of faces needing to be sharpened on the distal end 26 of the tool bit 24 and a corresponding angle needing to be sharpened onto each face. Thus, as can be appreciated embodiments of the present invention contemplate a wide range of numbers of bore holes 20 and corresponding orientations. In an embodiment that will be described in more detail below, the fixture 18 may include five bore holes, with each bore hole extending in a unique direction through the transverse width of the fixture. Such an embodiment may be used, for instance, to sharpen a distal end of a tool bit with five faces.

Returning to FIGS. 3-4, the tool bit assembly 22 comprises a carrier block 48 with an axial recess 50 for receiving the tool bit 24, and a receiver 52 with an axial recess 54 for receiving the carrier block, with the receiver capable of being removably secured to the distal end 40 of the fixture 18. The carrier block 48 may be generally cylindrical in shape with a longitudinal axis and may include proximal and distal ends 56, 58. A flange 60 is formed adjacent the distal end 58 of the carrier block 48 and an annular groove 62 extends around the carrier block at a position intermediate the flange 60 and the proximal end 56. The axial recess 50 is formed in the distal end 58 and extends in a direction substantially parallel to the longitudinal axis. First and second threaded transverse openings 64, 66 are located between the flange 60 and the distal end 58 of the carrier block 48 and extend between the axial recess 50 and a region exterior of the carrier block. First and second set screws 68, 70 are received in the first and second threaded transverse openings 64, 66, respectively, and once the tool bit 24 is inserted in the axial recess 50, the set screws are operable to secure the tool bit in place. It is noted that in certain embodiments, the carrier block 48 may only have a single set screw that holds the tool bit 24 in place within the axial recess 50. An axial groove 72 is formed into an exterior surface of the carrier block in a region between the flange 60 and the carrier block's distal end 58. An O-ring (not shown), formed of material which is resilient relative to the carrier block, may be received in the annular groove 62 of the carrier block. The O-ring is sized to provide frictional engagement between the carrier block 48 and the receiver 52 when the carrier block is inserted into the receiver's axial recess 54.

Embodiments of the present invention may provide for the receiver 52 to be generally rectangular in shape with a longitudinal axis and including proximal and distal ends 74, 76. The axial recess 54 is formed in the distal end 76 and extends in a direction substantially parallel to the longitudinal axis. First and second distal threaded transverse openings 78, 80 are located adjacent to the distal end 76 of the receiver 52 and extend an entire width of the receiver, generally perpendicular to the receiver's longitudinal axis. A distal set screw 82 may be received in the distal threaded transverse openings 78, 80, and once the proximal end 56 of the carrier block 48 is inserted in the axial recess 54 of the receiver 52, the distal set screw is operable to secure the carrier block in place. An axial key 84 is formed adjacent to the distal end 76 of the receiver 52, near the axial recess 54. The axial key 84 cooperates with the axial groove 72 of the carrier block 48 to retain the carrier block against rotational movement when the carrier block is inserted into the receiver's axial recess 54. The receiver 52 further includes first and second proximal transverse openings 86, 88 located adjacent to the proximal end 74 of the receiver, each extending through an entire width of the receiver. The openings 86, 88 are orientated such that they perpendicularly intersect with each other and the receiver's longitudinal axis. A proximal screw fastener 90 is received in one of the openings 86, 88 and is adapted to be simultaneously received by the threaded transverse opening 46 of the fixture 18, so as to secure the receiver 52 to the distal end 40 of the fixture. Because the proximal transverse openings 86, 88 intersect perpendicularly, the receiver 52 may be secured to the fixture 18 in four orientations, with each orientation being a 90 degree rotation from an adjacent orientation.

Figure 6:
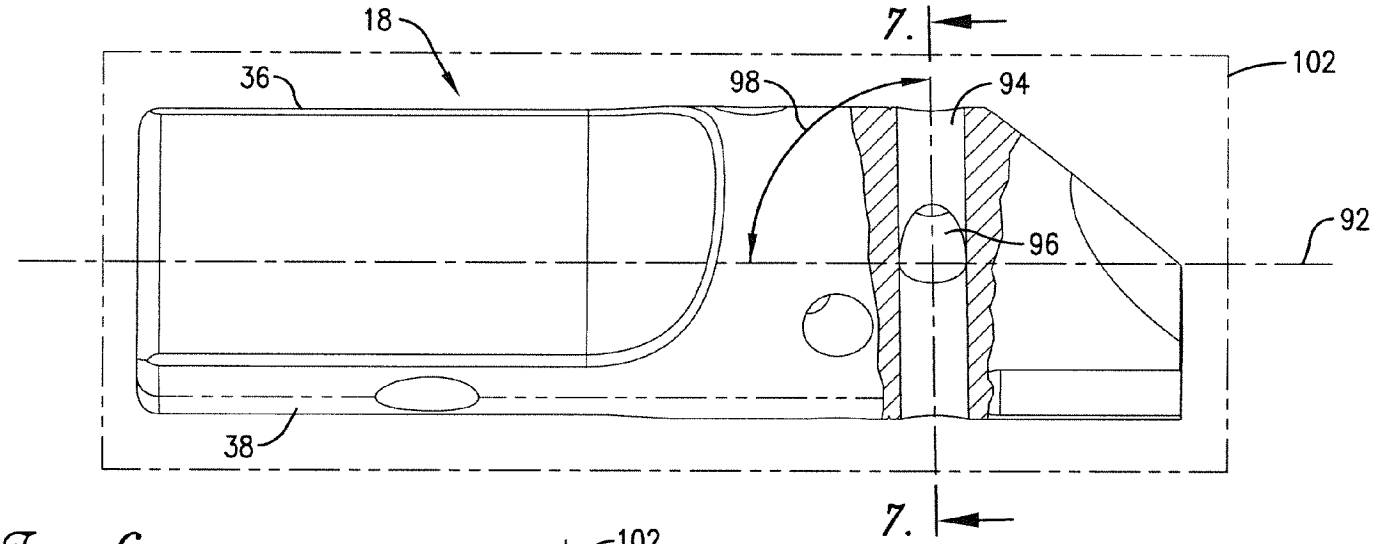
FIG. 6 is an elevation view of a fixture of the tool bit sharpening system of FIG. 1, with a partial sectional view of a first bore hole and a second bore hole.
Figure 8:
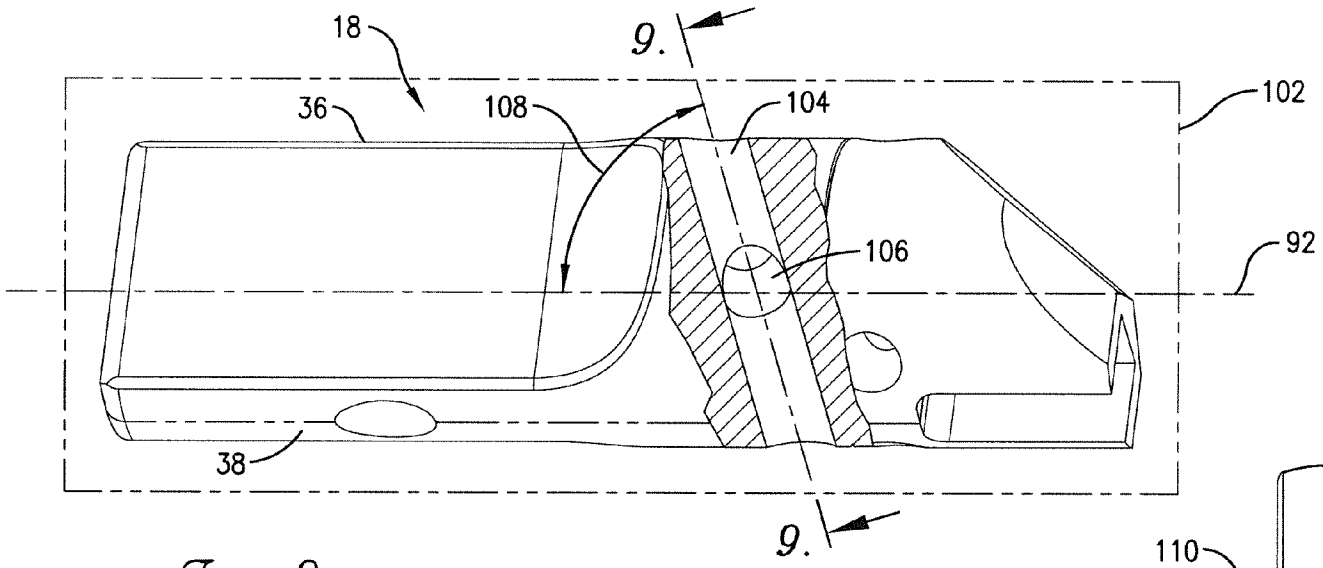
FIG. 8 is an elevation view of the fixture of the tool bit sharpening system of FIGS. 1 and 6, with a partial cross-sectional view of a third bore hole and a fourth bore hole.
Figure 10:
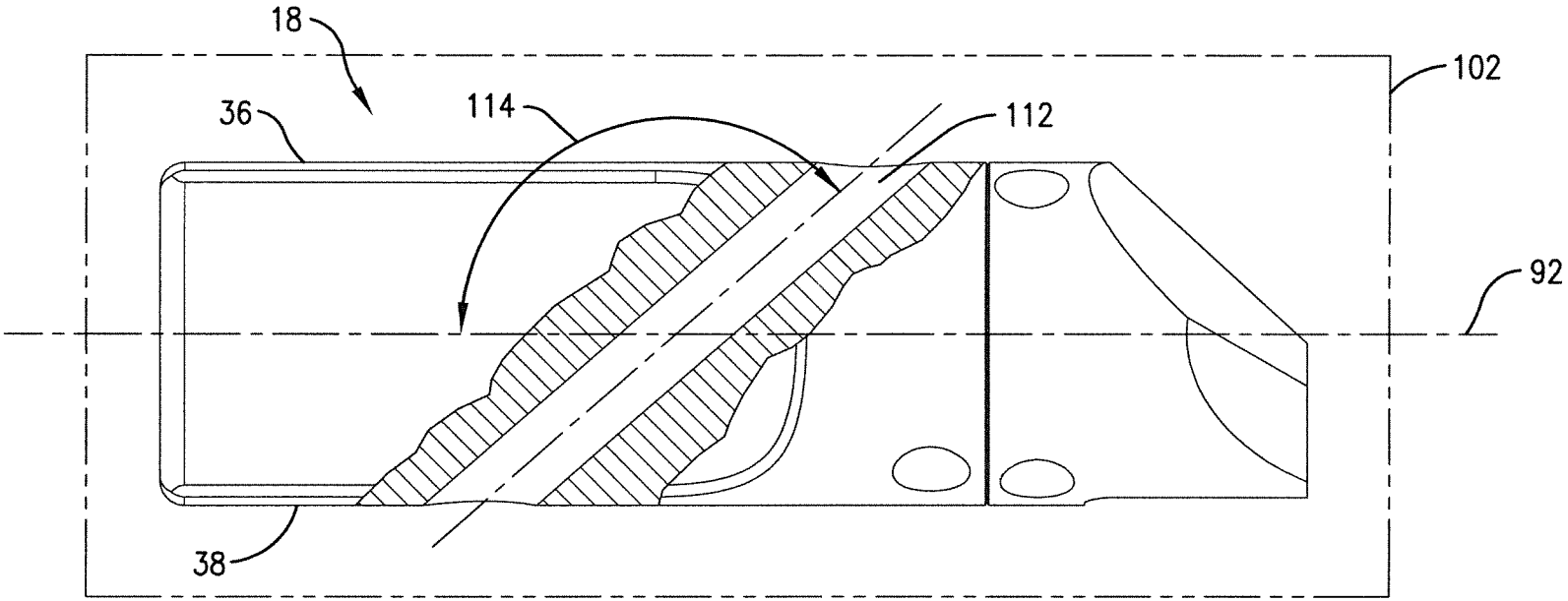
FIG. 10 is an elevation view of the fixture of the tool bit sharpening system of FIGS. 1, 6, and 8, with a partial cross-sectional view of a fifth bore hole.
Figure 11:
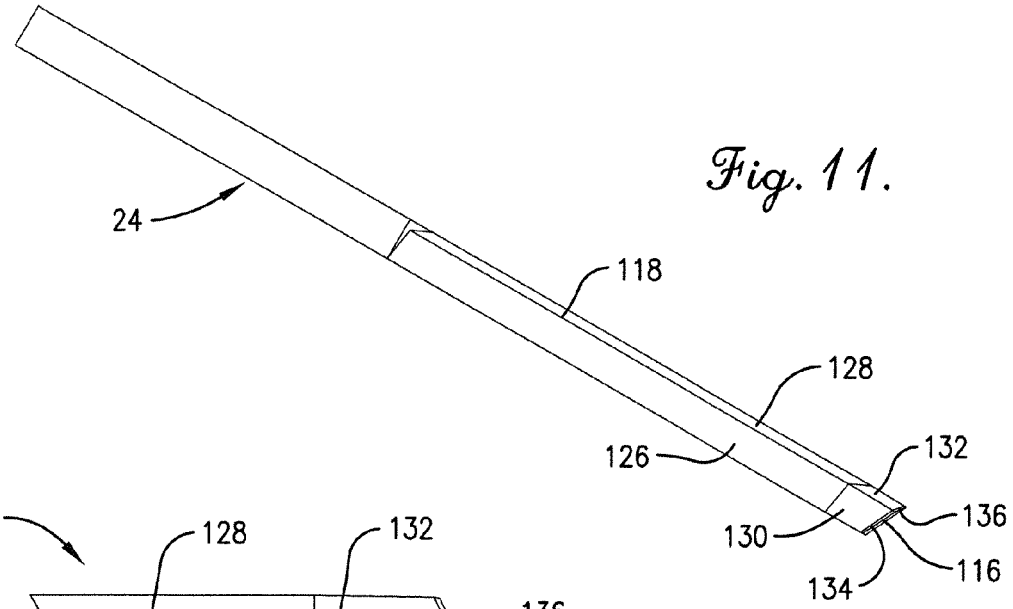
FIG. 11 is perspective view of a tool bit of the tool bit sharpening system of FIG. 1.
Figure 12:
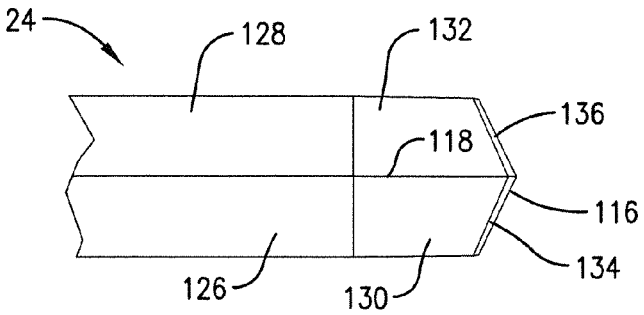
FIG. 12 is a fragmented bottom plan view of the tool bit of FIG. 11.
Figure 13:
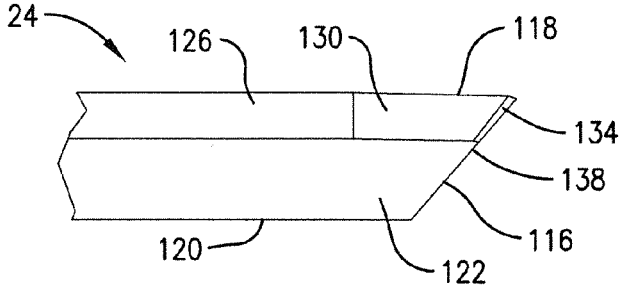
FIG. 13 is a fragmented side elevation view of the tool bit of FIG. 11.
Figure 14:
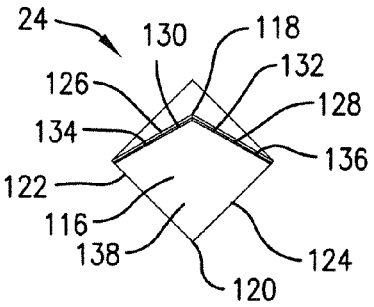
FIG. 14 is a right-end elevation view of the tool bit of FIG. 11.
Figure 15:
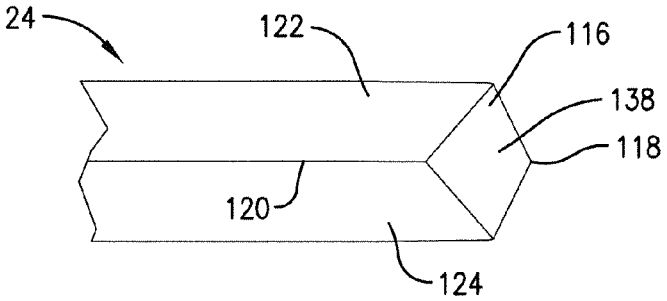
FIG. 15 is a fragmented top plan view of the tool bit of FIG. 11.

As described above, embodiments of the present invention provide the fixture 18 to include the plurality of bore holes 20, with each bore hole in the plurality orientated at different angles within the fixture. In certain embodiments, the plurality of bore holes 20 may include one, two, three, four, or any other number of bore holes, as may be required to sharpen a cutting edge on an engraving bit. However, certain embodiments, such as illustrated in the figures herein, provide for the number of bore holes in the plurality to be five. As illustrated in FIGS. 6, 8, and 10, each bore hole may pass through a longitudinal centerline 92 of the fixture 18. However, it is noted that the bore holes 20 are not required to pass through the longitudinal centerline 92 of the fixture 18. For instance, the bore holes 20 may be positioned within the fixture 18 such that they are offset from the centerline 92 and pass through the fixture without intersecting or abutting the centerline.

Figure 7:
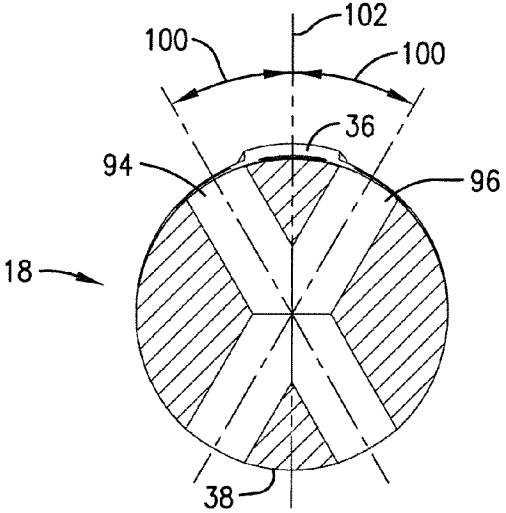
FIG. 7 is a transverse cross-sectional view taken along the line 7-7 of FIG. 6.

Turning to FIGS. 6-7, the fixture 18 may include first and second bore holes 94, 96 that intersect each other. In certain embodiments, such as is illustrated in FIGS. 6-7, the first and second bore holes 94, 96 may intersect each other at their respective midpoints. However, it is noted that the first and second bore holes 94, 96 are not required to intersect at their midpoints, such that they may generally intersect each other at intersection points, which may or may not be their respective midpoints. As best illustrated by FIG. 6, the first and second bore holes 94, 96 may also intersect at pitch angles 98 with a portion of the centerline 92 that lies proximally with respect to the intersection points of the first and second bore holes. As previously noted, the first and second bore holes 94, 96 are not required to intersect with the centerline 92. For instance, the first and second bore holes 94, 96 may generally intersect at pitch angles 98 with a first longitudinal line (not shown) that intersects both bore holes 94, 96 at their respective intersection points and is parallel to the centerline 92. In certain embodiments and as best illustrated by FIG. 6, the first and second bore holes 94, 96 may preferably intersect the centerline 92 at pitch angles 98 that are between about 74 degrees to about 104 degrees; about 84 degrees to about 94 degrees; or about 89 degrees. As best illustrated by FIG. 7, the first and second bore holes 94, 96 may further be positioned such that they intersect, at roll angles 100, with a centerline plane 102 that includes the fixture's centerline 92 and that bisects a top-most portion of the fixture's top side 36 and a bottom-most portion of the fixture's bottom side 38. However, the first and second bore holes 94, 96 are not required to intersect with the centerline plane 102. For instance, the first and second bore holes 94, 96 may generally intersect at roll angles 100 with a first longitudinal plane (not shown), with the first longitudinal plane being positioned such that it includes the first longitudinal line and intersects with each of the first and second bore holes at equal magnitude roll angles. Returning to the embodiments illustrated in FIGS. 6-7, the first and second bore holes 94, 96 may preferably intersect the centerline plane 102 at roll angles 100 that are generally acute angles (i.e., less than 90 degrees); between about 20 degrees to about 40 degrees; or about 30 degrees. From the above description, it should be understood that the centerline 92 and the centerline plane 102 may be specific embodiments of the first longitudinal line and the first longitudinal plane, respectively. Thus, the angles specified above with respect to the center line 92 and the centerline plane 102 may similarly be applied to the more generalized embodiments of the first longitudinal line and the first longitudinal plane.

Figure 9:
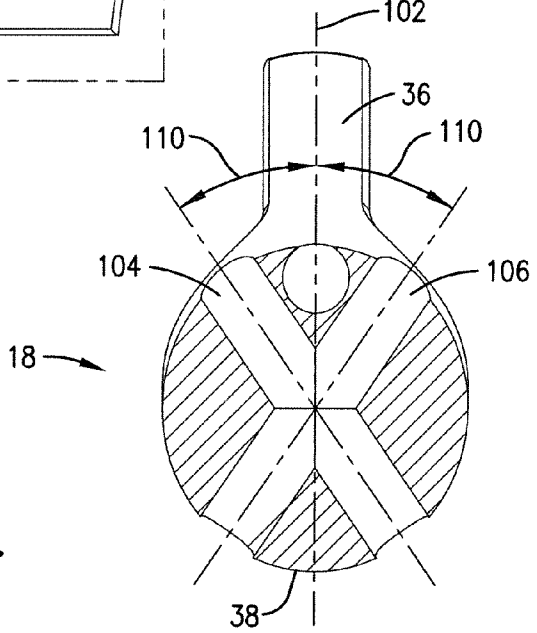
FIG. 9 is a transverse cross-sectional view taken along the line 9-9 of FIG. 8.

Turning to FIGS. 8-9, the fixture 18 may include third and fourth bore holes 104, 106 that intersect each other. In certain embodiments, such as is illustrated in FIGS. 8-9, the third and fourth bore holes 104, 106 may intersect each other at their respective midpoints. However, it is noted that the third and fourth bore holes 104, 106 are not required to intersect at their midpoints, such that they may intersect each other at intersection points that may or may not be their respective midpoints. In general, the intersection points of the third and fourth bore holes 104, 106 lie proximally with respect to the intersection points of the first and second bore holes 94, 96. As best illustrated by FIG. 8, the third and fourth bore holes 104, 106 may intersect, at pitch angles 108, with a portion of the centerline 92 that lies proximally with respect to the intersection points of the third and fourth bore holes. As previously noted, third and fourth bore holes 104, 106 are not required to intersect at the centerline 92. For instance, the third and fourth bore holes 104, 106 may intersect at pitch angles 108 with a second longitudinal line (not shown) that intersects both bore holes 104, 106 at their respective intersection points and is parallel to the centerline 92. In certain embodiments and as best illustrated by FIG. 6, the third and fourth bore holes 104, 106 may preferably intersect the centerline 92 at pitch angles 108 that are between about 61 degrees to about 91 degrees; about 71 degrees to about 81 degrees; or about 76 degrees. As best illustrated by FIG. 9, the third and fourth bore holes 104, 106 are further positioned such that they intersect, at roll angles 110, with the centerline plane 102. However, the third and fourth bore holes 104, 106 are not required to intersect with the centerline plane 102. For instance, the third and fourth bore holes 104, 106 may intersect at roll angles 110 with a second longitudinal plane (not shown), with the second longitudinal plane being positioned such that it includes the second longitudinal line and intersects with each of the third and fourth bore holes 104, 106 at equal magnitude roll angles. Returning to the embodiments illustrated in FIGS. 8-9, the third and fourth bore holes 104, 106 preferably intersect the centerline plane 102 at roll angles 110 that are generally acute angles; between about 30 degrees to about 45 degrees; or about 36 degrees. From the above description, it should be understood that the center line 92 and the centerline plane 102 may be specific embodiments of the second longitudinal line and the second longitudinal plane, respectively. Thus, the angles specified above with respect to the center line 92 and the centerline plane 102 may similarly be applied to the more generalized embodiments of the second longitudinal line and the second longitudinal plane.

As best illustrated by FIG. 10, the fixture 18 may include a fifth bore hole 112 that intersects a third longitudinal line (not shown) at an intersection point of the fifth bore hole. The third longitudinal line intersects with the fifth bore hole 112 at its intersection point and is parallel to the centerline 92. In certain embodiments, the intersection point may be the midpoint of the fifth bore hole 112. In general, the intersection point of the fifth bore hole 112 lies proximally with respect to the intersection points of the third and fourth bore holes 104, 106. In certain embodiments, such as illustrated by FIG. 10, the fifth bore hole 112 is positioned such that the centerline plane 102 bisects and is parallel to the fifth bore hole. However, it is noted that fifth bore hole is not required to be bisected by the centerline plane 102. The fifth bore hole 112 may be bisected by a third longitudinal plane (not shown), with the third longitudinal plane being positioned such that it bisects the fifth bore hole and includes the third longitudinal line. As illustrated in FIG. 10, the fifth bore hole 112 may intersects, at a pitch angle 114, with a portion of the centerline 92 that lies proximally with respect to the intersection point of the fifth bore hole. In certain embodiments, the fifth bore hole 112 intersects the centerline 92 at pitch angle 114 that is generally obtuse (i.e., greater than 90 degrees); between about 130 degrees to about 150 degrees; or about 139 degrees. From the above description, it should be understood that the center line 92 and the centerline plane 102 may be specific embodiments of the third longitudinal line and the third longitudinal plane, respectively. Thus, the angles specified above with respect to the center line 92 may similarly be applied to the more generalized embodiments of the third longitudinal line.

Although the above descriptions provide for a first, second, and third longitudinal line and a first, second, and third longitudinal plane, it is understood that each longitudinal line may be collinear with the other longitudinal lines and that each longitudinal plane may be coplanar with the other longitudinal planes. Thus, the first, second, and third longitudinal lines may each refer to the same line, and similarly, the first, second, and third longitudinal planes may each refer to the same plane.

Embodiments of the present invention include a method for sharpening a tool bit in a fixed geometry. Embodiments provide for a variety of styles and shapes of tool bits to be sharpened. Tool bits are generally linear pieces of high-strength metal or metal alloys. Manufacturers form the tool bits into standard longitudinal shapes such as rectangular cuboids with four longitudinal sides bounded by two square shaped ends, with each of the four longitudinal sides connected to an adjacent side via a longitudinal edge; parallelopipeds with four longitudinal sides bounded by two diamond shaped ends, with each of the four longitudinal sides connected to an adjacent side via a longitudinal edge; or cylinders with an annular side bounded by two circular-shaped ends.

The purpose of sharpening a tool bit is to form a cutting edge on an end of the tool bit. To form the cutting edge, various faces, or facets, can be ground, via a sharpening stone or other sharpening material, onto the end of the tool bit at various angles. For instance, FIGS. 11-15 illustrate rectangular tool bit 24, with a square-shaped end 116 and bottom and top longitudinal edges 118, 120, such that the tool bit is orientated with first and second top-facing longitudinal sides 122, 124 and first and second bottom-facing longitudinal sides 126, 128. It is noted that that although some of the figures illustrate the tool bit 24 with top features facing downward and bottom features facing upward, the definitions for the top and bottom, as used herein, are provided to maintain consistency with the orientation of the tool bit as the tool bit is being used by an engraver during an engraving operation. To sharpen a cutting edge onto the tool bit, first and second shape angle faces 130, 132 can be honed onto the end 116 of the tool bit 24 by grinding a portion of each of the bottom-facing sides 126, 128, respectively, of the tool bit adjacent to the end 116. In addition, first and second heel faces 134, 136 can be honed onto the end 116 of the tool bit 24 by again grinding a portion of the bottom-facing sides 126, 128, respectively, of the tool bit adjacent to the end 116. The first and second heel faces 134, 136 are generally ground onto the sides of the tool bit at steeper angles, with respect to a longitudinal axis of the tool bit, than shape angle faces 130, 132, so as to provide for optimal depth control when the tool bit is used for engraving. Further, a face angle face 138 can be honed onto the end 116 of the tool bit 24 by grinding a portion of the top edge 120 and top-facing sides 122, 124 of the tool bit adjacent to the end.

Embodiments of the present invention include a method for sharpening a tool bit in a fixed geometry. For instance, with a system of embodiments that includes a fixture with five bore holes each positioned at different angles, a user is capable of honing five faces on a proximal end of a tool bit to sharpen a cutting edge as described above. A method of embodiments of the present invention includes the first step of providing a tool bit sharpening system 10 with a base 12, including a support platform 14 and a guide rod 16; a fixture 18 having top and bottom sides 36, 38, distal and proximal ends 40, 42, and five linear bore holes 20 extending through a transverse width of the fixture; a linear tool bit 24 with proximal and distal ends; a tool bit support assembly 22 for receiving the tool bit and joining the tool bit to the fixture; and a sharpening material 28. To better illustrate the method of embodiment of the present invention, the remaining steps will be described with specific reference to fixture 18 of the system described above, and as illustrated in FIGS. 6-10, which include first, second, third, fourth, and fifth bore holes 94, 96, 104, 106, 112, respectively. It is additionally noted that the following steps are performed with the tool bit 24 inserted into the carrier block 48, and with the carrier block 48 aligned with the receiver 52, such that the axial key 84 of the receiver is received within the axial groove 72 of the carrier block.

Figure 16:
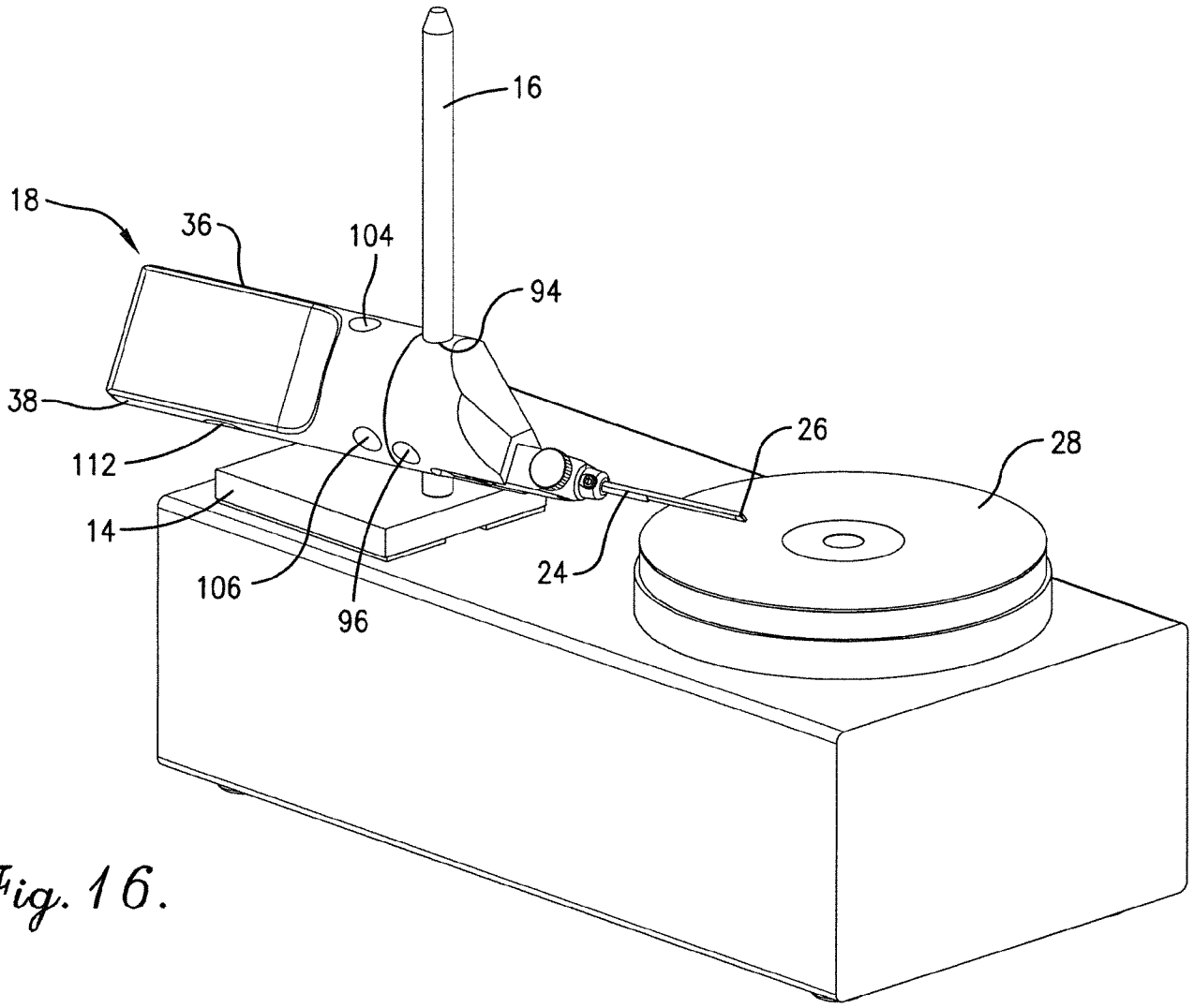
FIG. 16 is a perspective view of a tool bit sharpening system of embodiments of the present invention, with a fixture of the system positioned to form a first shape angle face on an end of a tool bit.
Figure 17:
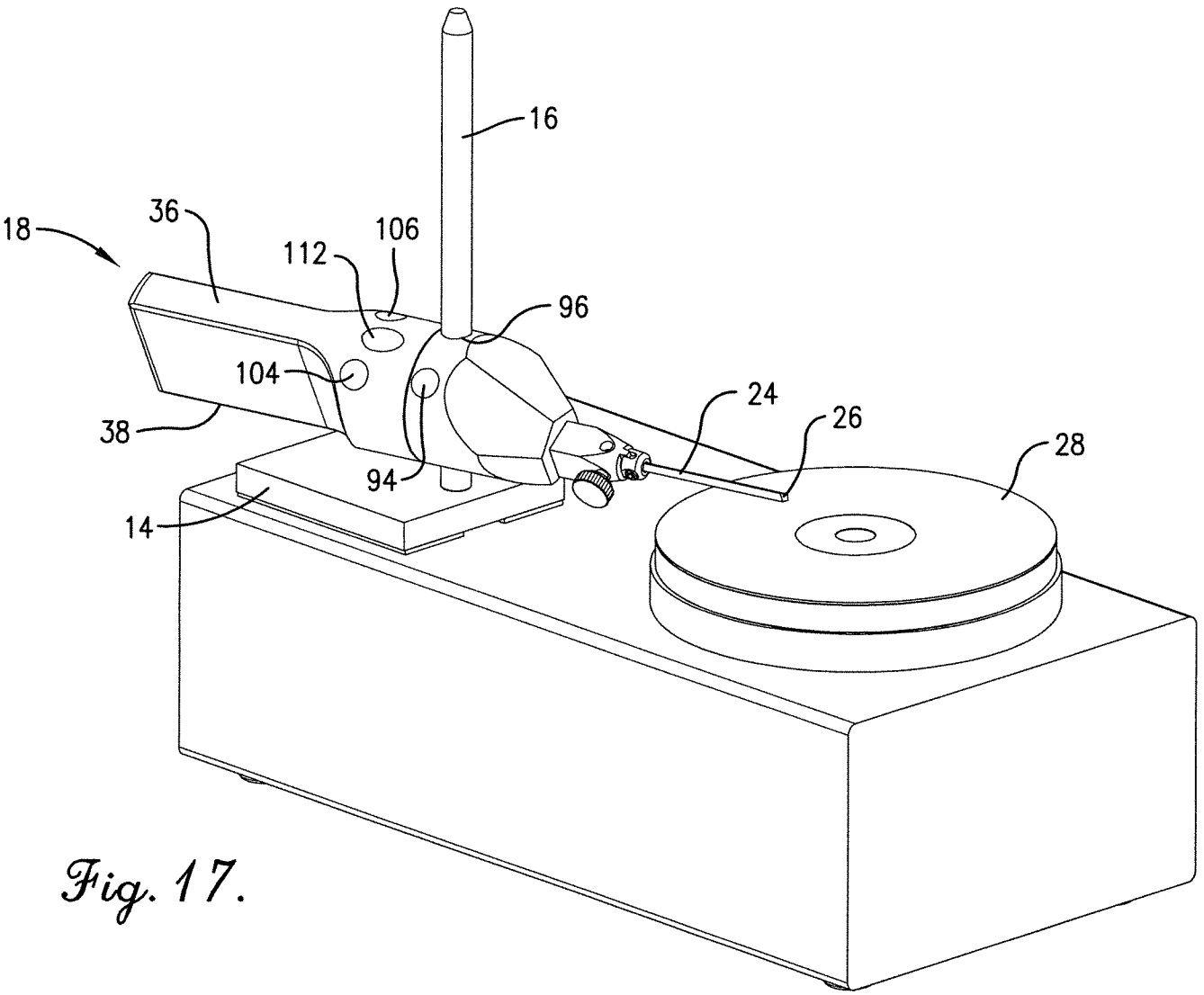
FIG. 17 is a perspective view of the tool bit sharpening system of FIG. 16, with the fixture of the system positioned to form a second shape angle face on the end of the tool bit.

In the second step, and as illustrated in FIG. 16, the guide rod 16 is inserted through first bore hole 94, starting at the bottom side 38 of the fixture 18, and the fixture is lowered around the guide rod until distal end 26 of the tool bit 24 contacts the sharpening material 28. In the next step, the sharpening material 28 is moved with respect to the tool bit 24 such that the sharpening material sharpens a first shape angle face on a first bottom-facing side of the distal end 26 of the tool bit 24. In the next step, and as illustrated in FIG. 17 the guide rod 16 is inserted through second bore hole 96, starting at the bottom side 38 of the fixture 18, and the fixture is lowered around the guide rod until the distal end 26 of the tool bit 24 contacts the sharpening material 28. In the next step, the sharpening material 28 is moved with respect to the tool bit 24 such that the sharpening material sharpens a second shape angle face on a second bottom-facing side of the distal end 26 of the tool bit 24.

Figure 18:
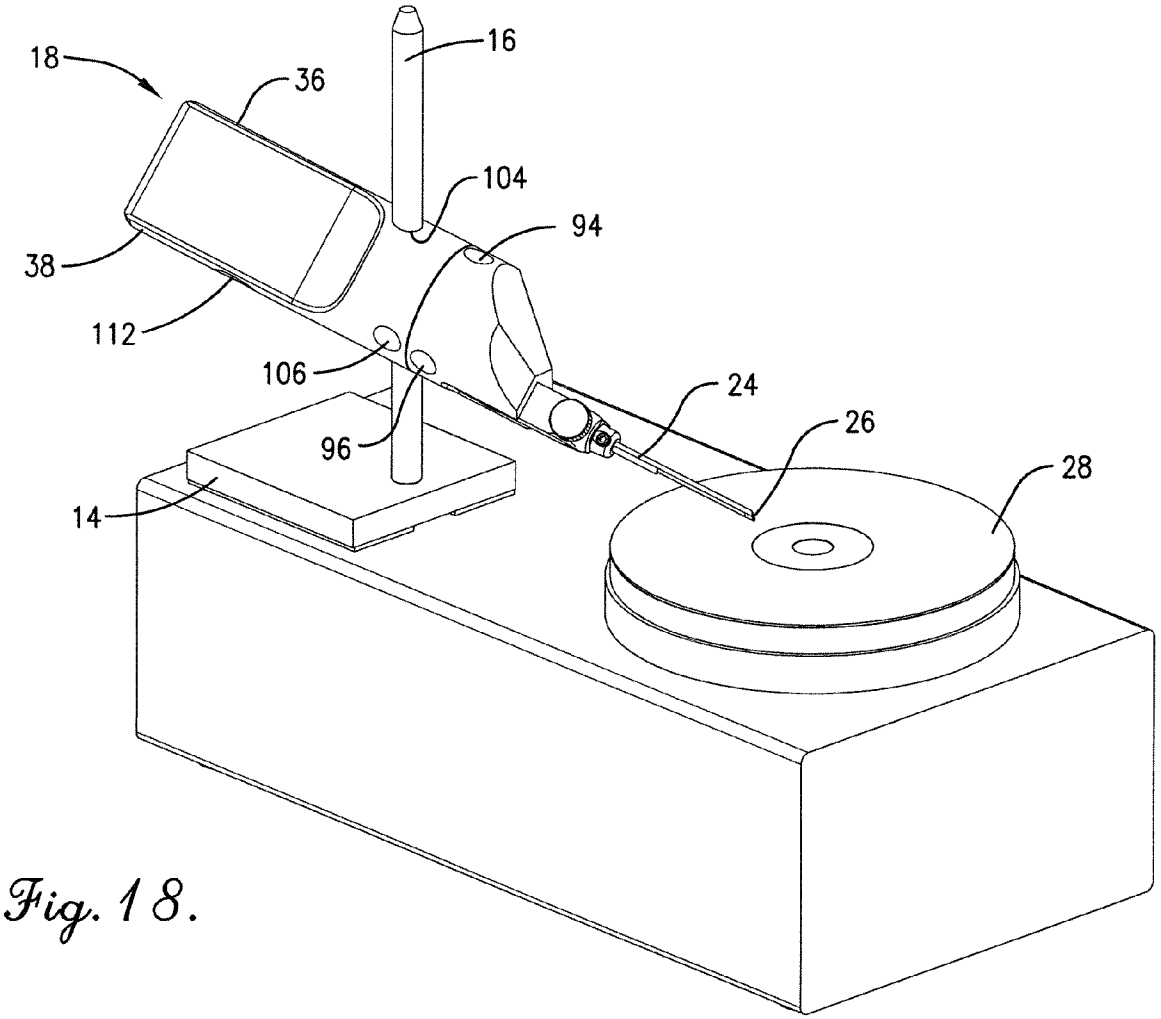
FIG. 18 is a perspective view of the tool bit sharpening system of FIGS. 16-17, with the fixture of the system positioned to form a first heel face on the end of the tool bit.
Figure 19:
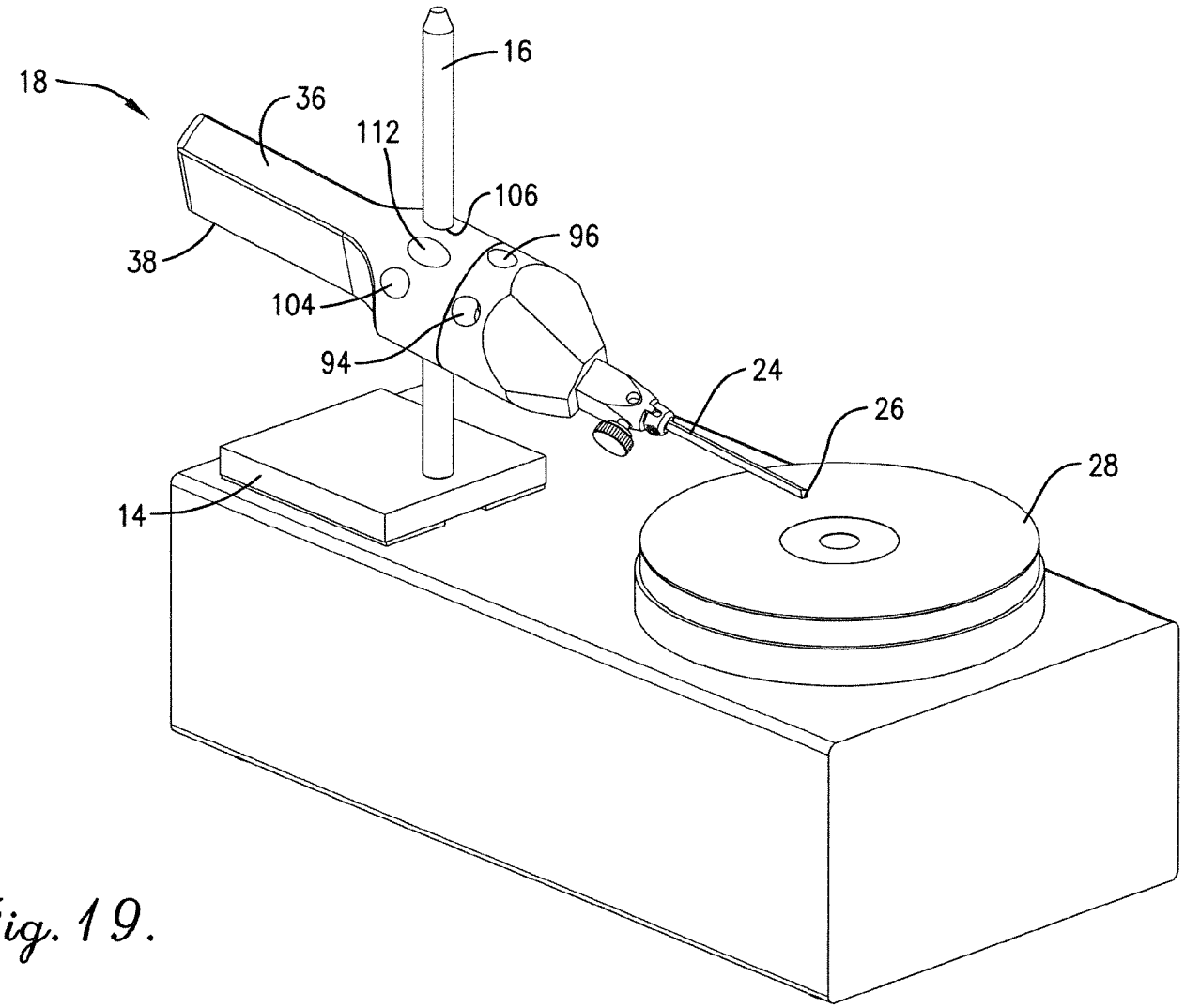
FIG. 19 is a perspective view of the tool bit sharpening system of FIGS. 16-18, with the fixture of the system positioned to form a second heel face on the end of the tool bit.

In the next step, and as illustrated in FIG. 18 the guide rod 16 is inserted through third bore hole 104, starting at the bottom side 38 of the fixture 18, and the fixture is lowered around the guide rod until the distal end 26 of the tool bit 24 contacts the sharpening material 28. In the next step, the sharpening material 28 is moved with respect to the tool bit 24 such that the sharpening material sharpens a first heel face on the first bottom-facing side of the distal end 26 of the tool bit 24. In the next step, and as illustrated in FIG. 19, the guide rod 16 is inserted through fourth bore hole 106, starting at the bottom side 38 of the fixture 18, and the fixture is lowered around the guide rod until the distal end 16 of the tool bit 24 contacts the sharpening material 28. In the next step, the sharpening material 28 is moved with respect to the tool bit such that the sharpening material sharpens a second heel face on the second bottom-facing side of the distal end 26 of the tool bit 24.

Figure 20:
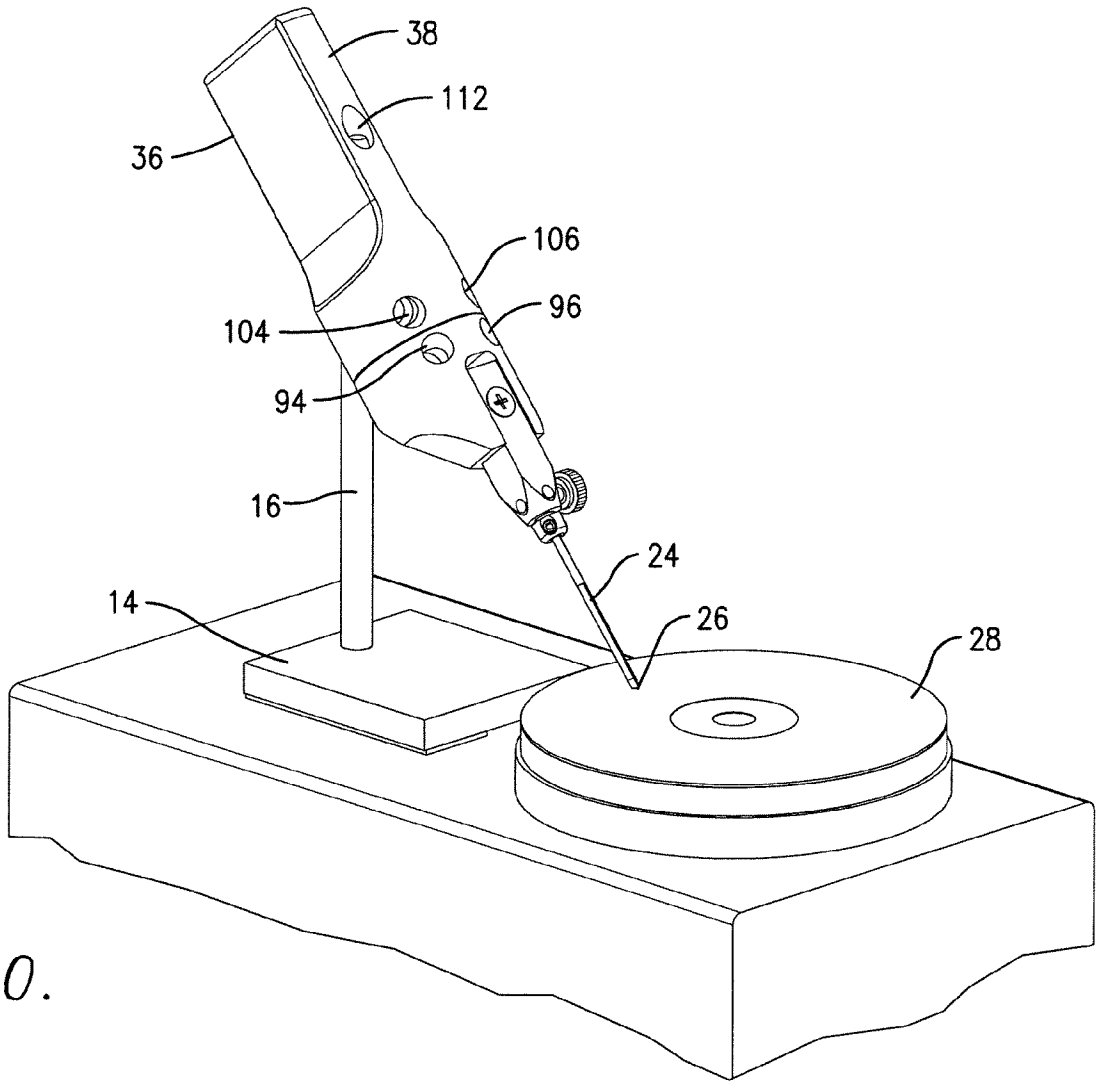
FIG. 20 is a perspective view of the tool bit sharpening system of FIGS. 16-19, with the fixture of the system positioned to form a face angle face on the end of the tool bit.

In the next step, and as illustrated in FIG. 20, the guide rod 16 is inserted through fifth bore hole 112, starting at the top side 36 of the fixture 18, and the fixture is lowered around the guide rod until the distal end 26 of the tool bit 24 contacts the sharpening material 28. In the next step, the sharpening material 28 is moved with respect to the tool bit 24 such that the sharpening material sharpens a face angle face on top-facing sides and a top edge of the distal end 26 of the tool bit 24.

Figure 21:
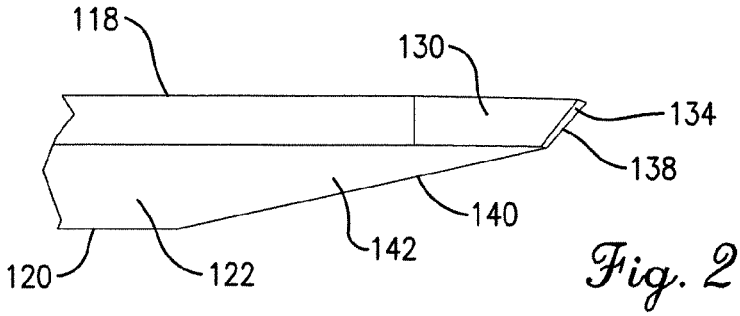
FIG. 21 is a fragmented side elevation view of a tool bit with a reduced top-surface.
Figure 22:
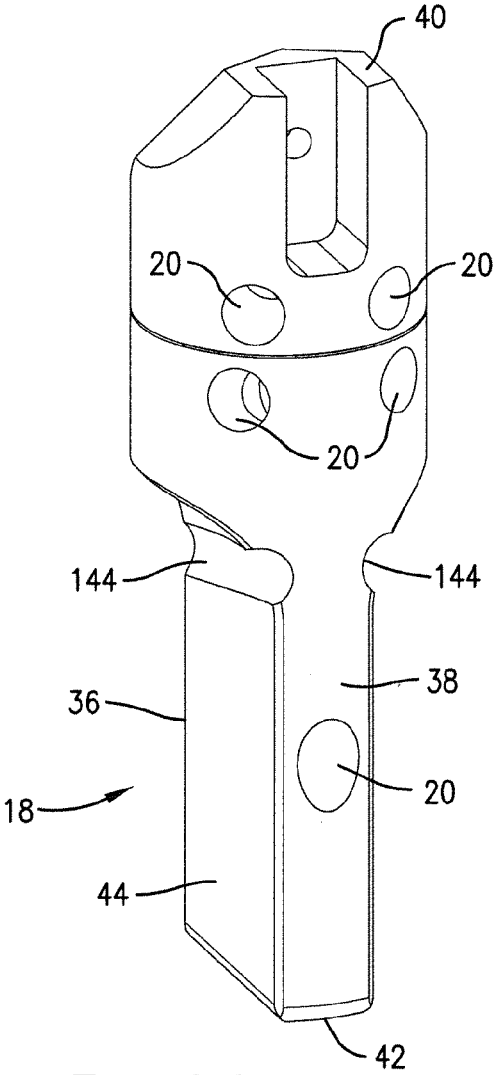
FIG. 22 is a bottom perspective view of a fixture of embodiments of the present invention, with linear grooves included on a handle of the fixture.
Figure 23:
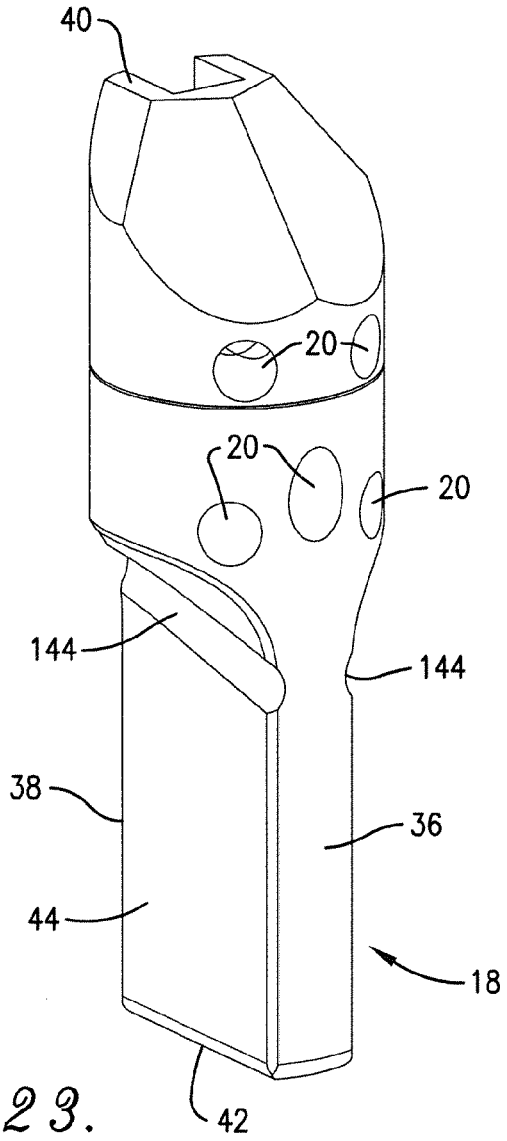
FIG. 23 is a top perspective view of the fixture of FIG. 22.

Turning to FIG. 21, even further embodiments of the present invention provide for a reduced top-surface 140 to be ground onto a top section 142 of the tool bit 24 including the top longitudinal edge 120 and the first and second top-facing longitudinal sides 122, 124 (top-facing side 124 not shown). Such reduced top-surface 140 may be used to reduce the amount of material on a top of the tool bit 24, so as to reduce the amount of material that must be ground during subsequent sharpenings. In addition, the reduced top-surface 140 may provide for increased visibility when engraving with the tool bit 24. As shown in FIGS. 22-23, embodiments of the present invention provide for the reduced top-surface 140 to be ground onto the tool bit by including linear grooves 144 on both sides of the handle 44 of the fixture 18. Certain embodiments of the present invention may provide for only a single linear groove 144 to be formed on one of the sides of the handle 44. In certain embodiments, the linear grooves 144 may be semi-cylindrical; however, in other embodiments the linear grooves may be semi-ellipsoidal, v-shaped, or the like. The linear grooves 144 generally extend along the sides of the handle 44 from the top side 36 of the fixture 18 to the bottom side 38 of the fixture.

Figure 24:
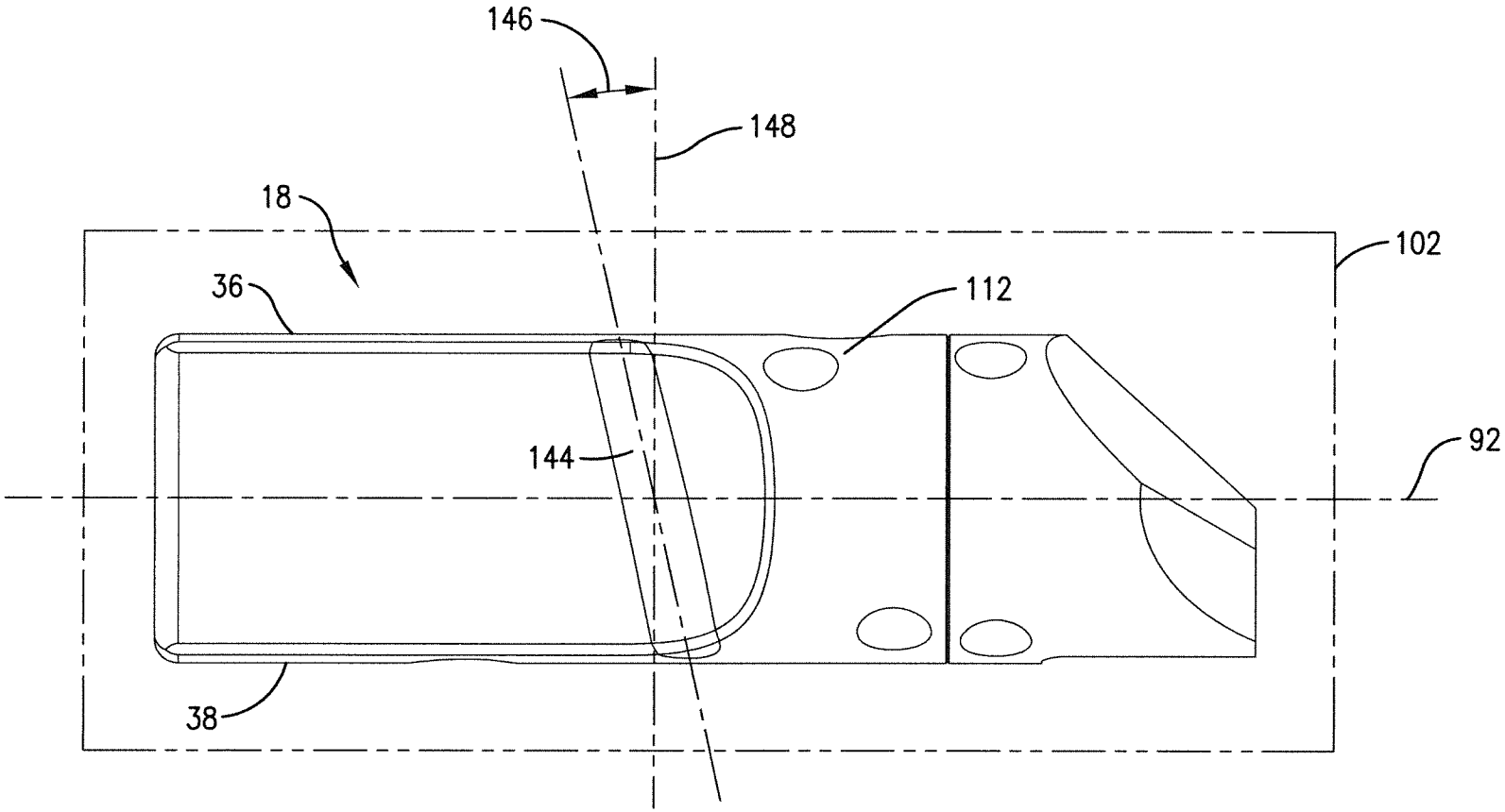
FIG. 24 is an elevation view of the fixture of FIGS. 22 and 23.

As best illustrated in FIG. 24, the linear grooves 144 are generally formed parallel to the centerline plane 102. In addition, the linear grooves 144 intersect at pitch angles 146 with a lateral plane 148. The lateral plane 148 bisects the fixture's centerline 92 at a midpoint of the linear grooves 144 and also intersects perpendicularly to the centerline plane 102. In certain embodiments, the linear grooves 144 preferably intersect the lateral plane 148 at pitch angles 146 that are between about 22 degrees to about 2 degrees; about 17 degrees to about 7 degrees; or about 12 degrees.

Figure 25:
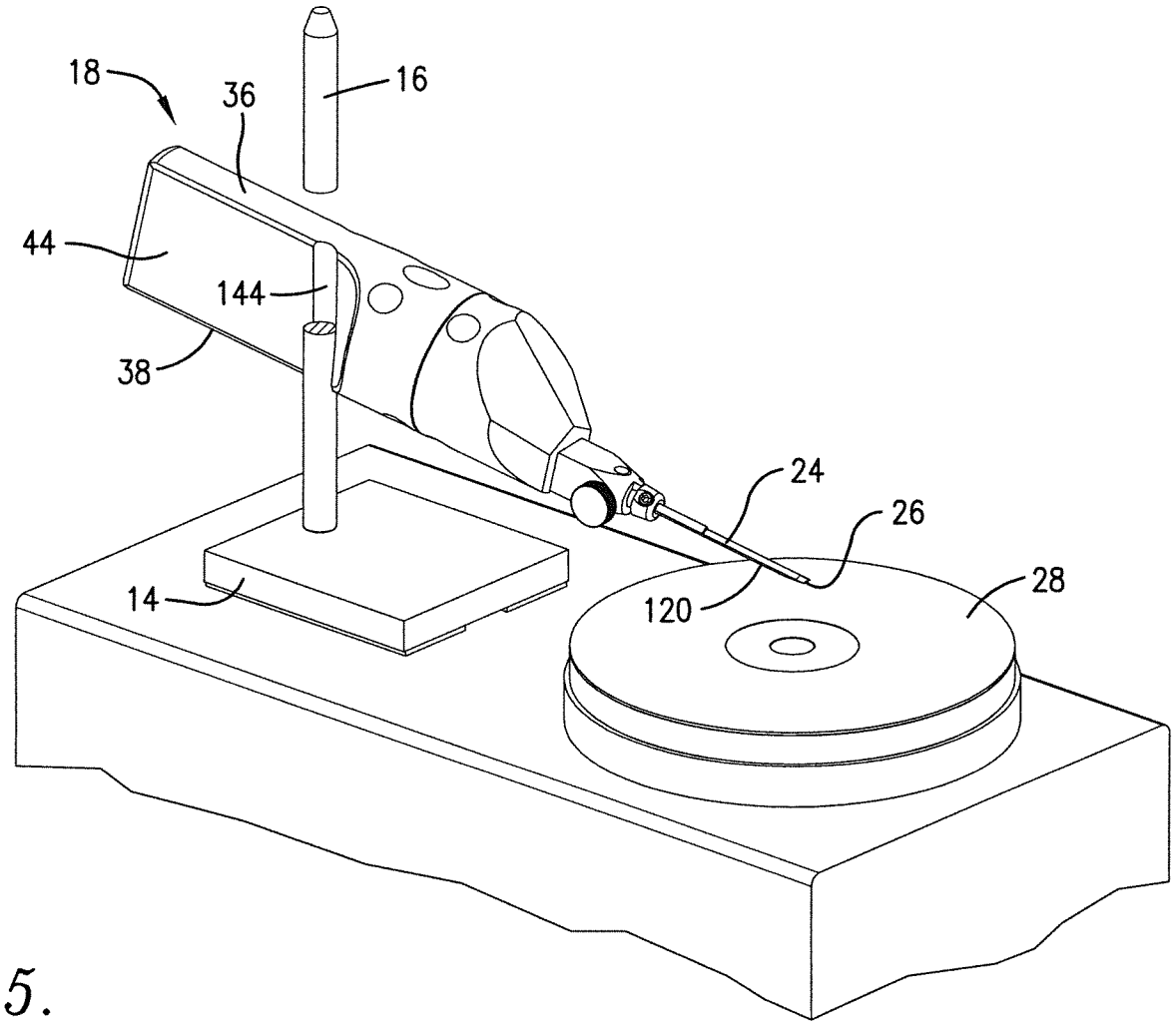
FIG. 25 is a fragmented perspective view of a tool bit sharpening system, including the fixture of FIGS. 22-24 with linear grooves on a handle of the fixture, and with the fixture positioned within the system to form a reduced top-surface on and end of a tool bit.

The following steps disclose how the reduced top-surface 140 is ground onto the top longitudinal edge 120 and the first and second top-facing longitudinal sides 122, 124 of the tool bit 24. It is noted, the following steps are performed with the tool bit 24 inserted into the carrier block 48, and the carrier block 48 being aligned with the receiver 52, such that the axial key 84 of the receiver is rotated 180 degrees from the axial groove 72 of the carrier block. As illustrated by FIG. 25, to grind the reduced top-surface 140 onto the top section 142 of the tool bit 24, the handle 44 of the fixture 18 is placed against the guide rod 16, such that one of the linear grooves 144 is aligned with and positioned adjacent to the guide rod. The fixture 18 is then lowered down the guide rod 16 until the top longitudinal edge 120 of the tool bit 24 comes into contact with the sharpening material 28. In the next step, the sharpening material 28 is moved with respect to the tool bit 24 such that the sharpening material sharpens a reduced top-surface 140 on the top section 142 of the tool bit 24 near its distal end 26.

Although the invention has been described with reference to the exemplary embodiments illustrated in the attached drawings, it is noted that equivalents may be employed and substitutions made herein without departing from the scope of the invention as recited in the claims. For example, although embodiments provided above describe a fixture with five bore holes, it is understood that five bore holes is purely exemplary, and embodiments of the present invention contemplate a fixture with any number of bore holes. In addition, the orientations of the bore holes within the fixture of the system of embodiments of the present invention provided above are similarly exemplary. Embodiments of the present invention contemplate the use of bore holes formed in a plurality of orientations, so as to sharpen a tool bit with any number of faces in any number of angles. Additionally, it is understood that the angles of the bore holes through the fixture correspond to the cutting edges being formed on the tool bit. However, embodiments of the present invention include different structural configurations that perform in a similar manner. Such as for instance, altering the orientation of the guide rod as it extends from the support platform. In such an equivalent structure, the angles of the bore holes may be different from those angles disclosed herein, but such structure may still provide for the cutting edges disclosed herein to be formed on a tool bit. Further, certain embodiments of the present invention may provide for functionality of the tool bit sharpening system described herein, to be similarly accomplished by the use of linear grooves in place of the bore holes. Thus, embodiments of the present invention contemplate sharpening a tool in a fixed geometry using linear grooves as opposed to linear bore holes.

Having thus described various embodiments of the invention, what is claimed as new and desired to be protected by Letters Patent includes the following:

1. A system for sharpening a tool bit in a fixed geometry, the system comprising:

a base including a support platform and a guide rod, with a bottom end of the guide rod attached to and extending from the platform;

a fixture having top and bottom sides, proximal and distal ends, and comprising a longitudinal extending body with at least five linear bore holes extending through a transverse width of the fixture, wherein each bore hole is operable to receive at least a portion of the guide rod, wherein each bore hole extends from the bottom side of the fixture to the top side of the fixture and intersects a longitudinal line of the fixture at an intersection point of the bore hole, wherein the longitudinal line of the fixture is parallel to or collinear with a longitudinal centerline of the fixture; and a tool bit support assembly removeably attached to the distal end of the fixture and operable to receive the tool bit and to join the tool bit with the fixture.

2. The system of claim 1, wherein the at least five bore holes are comprised of— a first and a second bore hole that intersect each other at their respective intersection points, wherein each of the first and second bore holes intersect at pitch angles, between about 74 degrees to about 104 degrees, with a portion of the longitudinal line that lies proximally with respect to the intersection points of the first and second bore holes, wherein each of the first and second bore holes intersect at acute roll angles with respect to a longitudinal plane that includes the longitudinal line and that intersects the first and second bore holes at equal magnitude roll angles, a third and fourth bore hole that intersect each other at their respective intersection points and whose intersection points lie proximally with respect to the intersection points of the first and second bore holes, wherein each of the third and fourth bore holes intersect at pitch angles, between about 61 degrees to about 91 degrees, with a portion of the longitudinal line that lies proximally with respect to the intersection points of the third and fourth bore holes, wherein each of the third and fourth bore holes intersect at acute roll angles with the longitudinal plane; and a fifth bore hole whose intersection point lies proximally with respect to the intersection points of the third and fourth bore holes, wherein the fifth bore hole is positioned such that the longitudinal plane bisects and is parallel to the fifth bore hole, wherein the fifth bore hole intersect at an obtuse pitch angle with a portion of the longitudinal line that lies proximally with respect to the intersection point of the fifth bore hole.

3. The system of claim 2, with the first and second bore holes having— the pitch angles between about 84 degrees to about 94 degrees with respect to the intersection with the portion of the longitudinal line that lies proximally with respect to the intersection points of the first and second bore holes, the roll angles ranging from about 20 degrees to about 40 degrees with respect to the intersection with the longitudinal plane.

4. The system of claim 3, with the third and fourth bore holes having— the pitch angles ranging from about 71 degrees to about 81 degrees with respect to the intersection with the portion of the longitudinal line that lies proximally with respect to the intersection points of the third and fourth bore holes, the roll angles ranging from about 30 degrees to about 45 degrees with respect to the intersection with the longitudinal plane.

5. The system of claim 4, with the fifth bore hole having the obtuse pitch angle ranging from about 130 degrees to about 150 degrees with respect to the intersection with the portion of the longitudinal line that lies proximally with respect to the intersection point of the fifth bore hole.

6. The system of claim 1, with the tool bit support assembly comprising:

a carrier block having a longitudinal axis, proximal and distal ends, and a flange adjacent to the distal end of the carrier bock, with the flange including an axial groove adjacent to its outer surface, wherein the distal end of the carrier block includes an axial recess generally parallel to the longitudinal axis and operable to receive a proximal end of the tool bit; and a receiver having a longitudinal axis, proximal and distal ends, with an axial key extending from its distal end and positioned adjacent to the receiver's outer surface, wherein, the distal end of the receiver includes an axial recess that is operable to receive the proximal end of the carrier block, wherein, the axial key of the receiver is operable to engage with the axial groove of the carrier block such that upon receipt of the carrier block by the receiver, the carrier block's rotational movement is restricted, wherein, the proximal end of the receiver is removably secured to the distal end of the fixture.

7. The system of claim 6, wherein the carrier block further includes— threaded transverse opening between the flange and the distal end of the carrier block; and a set screw received in the threaded transverse opening and operable to retain a proximal end of the tool bit in the axial recess of the carrier block.

8. The system of claim 7, wherein the receiver further includes— two threaded distal transverse openings adjacent to the receiver's distal end, wherein the two openings perpendicularly intersect at the receiver's longitudinal axis; and a set screw received in one of the two threaded transverse openings and operable to retain a proximal end of the carrier block in the axial recess of the receiver.

9. The system of claim 6, wherein the fixture further includes a threaded transverse opening adjacent its distal end.

10. The system of claim 9, wherein the receiver further includes— two proximal transverse openings adjacent to the receiver's proximal end, wherein the two openings perpendicularly intersect at the receiver's longitudinal axis, and a screw fastener received in one of the two transverse openings and operable to retain a proximal end of the receiver to the distal end of the fixture, such that the receiver can be secured to the fixture in four orientations.

11. A method of sharpening a tool bit in a fixed geometry comprising the steps of:

providing a tool bit sharpening system having— a base including a support platform and a guide rod, with a bottom end of the guide rod attached to and extending from the platform, a fixture having top and bottom sides, proximal and distal ends, and comprising a longitudinal extending body with at least five linear bore holes extending through a transverse width of the fixture, wherein each bore hole extends from the bottom side of the fixture to the top side of the fixture and intersects a longitudinal line of the fixture at an intersection point of the bore hole, wherein the longitudinal line of the fixture is parallel to or collinear with a longitudinal centerline of the fixture, a linear tool bit with proximal and distal ends, and a tool bit support assembly for receiving the tool bit and joining the tool bit with the fixture, wherein the linear tool bit is secured to the tool bit support assembly, and the tool bit support assembly is secured to the fixture;

inserting the guide rod through a first bore hole of the at least five linear bore holes, starting at the bottom of the fixture, and lowering the fixture around the guide rod until the distal end of the tool bit contacts a sharpening material;

causing the sharpening material to move with respect to the tool bit such that the sharpening material forms a first shape angle face on a first bottom-facing side of the distal end of the tool bit;

inserting the guide rod through a second bore hole of the five linear bore holes, starting at the bottom of the fixture, and lowering the fixture around the guide rod until the distal end of the tool bit contacts the sharpening material;

causing the sharpening material to move with respect to the tool bit such that the sharpening material forms a second shape angle face on a second bottom-facing side of the distal end of the tool bit;

inserting the guide rod through a third bore hole of the five linear bore holes, starting at the bottom of the fixture, and lowering the fixture around the guide rod until the distal end of the tool bit contacts the sharpening material;

causing the sharpening material to move with respect to the tool bit such that the sharpening material forms a first heel face on the first bottom-facing side of the distal end of the tool bit;

inserting the guide rod through a fourth bore hole of the five linear bore holes, starting at the bottom of the fixture, and lowering the fixture around the guide rod until the distal end of the tool bit contacts the sharpening material;

causing the sharpening material to move with respect to the tool bit such that the sharpening material forms a second heel face on the second bottom-facing side of the distal end of the tool bit;

inserting the guide rod through a fifth bore hole of the five linear bore holes, starting at the top of the fixture, and lowering the fixture around the guide rod until the distal end of the tool bit contacts the sharpening material; and causing the sharpening material to move with respect to the tool bit such that the sharpening material forms a face angle face on top-facing sides of the distal end of the tool bit.

12. The method of claim 11, wherein the linear tool bit of the tool sharpening system has one of a parallelepiped shape, a rectangular cuboid shape, or a cylinder shape.

* * * * *